US006880632B2

(12) United States Patent
Tom et al.

(10) Patent No.: US 6,880,632 B2
(45) Date of Patent: Apr. 19, 2005

(54) CALIBRATION ASSEMBLY FOR AN INTERACTIVE SWAGE

(75) Inventors: Andy Tom, Houston, TX (US); Sidney K. Smith, Jr., Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 18 days.

(21) Appl. No.: 10/387,049

(22) Filed: Mar. 12, 2003

(65) Prior Publication Data

US 2004/0177954 A1 Sep. 16, 2004

(51) Int. Cl.[7] ..... E21B 23/00
(52) U.S. Cl. ..... 166/217
(58) Field of Search ..... 166/217, 216, 166/250.01, 53, 66, 243; 285/382.4; 72/393, 120, 121, 125, 370.06, 370.08, 8.9, 11.6, 12.7, 15.5, 19.6, 17.3, 18.6; 29/890.044, 890.053, 707, 709, 407.01, 407.05

(56) References Cited

U.S. PATENT DOCUMENTS 3,602,031 A * 8/1971 Graff ..... 72/393
4,007,699 A * 2/1977 Clemens ..... 29/890.044
4,513,506 A * 4/1985 Vogeleer ..... 33/502
6,012,523 A 1/2000 Campbell et al.

FOREIGN PATENT DOCUMENTS

| | | |
|---|---|---|
| GB | 2346165 A | 8/2000 |
| JP | 2002321028 | 5/2002 |
| WO | WO 03/016669 A2 | 2/2003 |

* cited by examiner

*Primary Examiner*—Kenn Thompson
(74) *Attorney, Agent, or Firm*—Steve Rosenblatt

(57) ABSTRACT

A swaging tool is configured to drive the swage up a ramp until a series of dogs engages the inside wall of an outer tubular member. At that point the swage will be at the necessary position on the ramp to adequately expand the inner tubular for a proper supporting relation to the outer tubular. If the inside diameter of the outer tubular is at the high end of the tolerance allowed by API specifications, the diameter of the swage is increased to compensate. Similarly, if the inside diameter of the outer tubular is at the low end of the tolerance range of API specifications, then the dogs make contact with the inside wall sooner and the resulting diameter of the swage is necessarily smaller.

17 Claims, 1 Drawing Sheet

CALIBRATION ASSEMBLY FOR AN INTERACTIVE SWAGE

FIELD OF THE INVENTION

The field of this invention is swages for expansion of tubulars downhole and more particularly to a swage that can sense the dimension of the surrounding tubular to the tubular it is about to expand to compensate for dimensional variations in the surrounding tubular.

BACKGROUND OF THE INVENTION

A swage is frequently used to expand one tubular into another. In one case a liner is delivered into casing and a portion expanded against the casing to support the liner in the casing. Casing inside diameters have a range of internal diameters within the tolerances permitted by specifications of the American Petroleum Institute (API). If a fixed swage is used to expand the inner tubular or liner against an outer tubular or casing and the inside diameter of the casing is at the larger end of the allowable tolerance, then the anchor connection between the tubulars may not be sufficiently secure. On the other hand, if the internal diameter of the outer tubular is at the smaller end of the allowable tolerance, then a fixed swage sized for the middle of the tolerance range can over-expand the outer tubular possibly inducing stresses that could led to immediate or subsequent stress cracking and leakage at the connection between the tubulars. A given amount of force is required to push or pull a swage into the inner tubular to expand the inner tubular against the outer tubular. The amount of force is dependent on the amount of expansion of the inner tubular against the outer tubular. Usually, the greater the amount of expansion, the greater the amount of force is required to push or pull the swage. Therefore, a fixed swage that causes over-expansion of the tubular could require a force that is too high and not make a fixed swage to be economically or engineering feasible.

What is needed, and provided by the present invention, is a tool and method that takes into account the size of the inside diameter of the outer tubular to set up the swage to the appropriate dimension to snugly form the supporting connection between the tubulars while avoiding the risk of over-expansion of the outer tubular, at one extreme, and having the fixation contact force too low, at the other extreme. Swages that change dimension as between run in and swaging downhole have been used, as illustrated in U.S. Pat. No. 6,012,523. These devices have only two operative positions for run in and for swaging. The present invention is adjustable to a variety of diameters for swaging. Moreover, the actual diameter of swaging is determined by the actual sensed internal diameter of the outer tubular against which the inner tubular is to be expanded. These advantages and others of the present invention will be more readily appreciated by those skilled in the art from a review of the description of the preferred embodiment and the claims, which appear below.

SUMMARY OF THE INVENTION

A swaging tool is configured to drive the swage up a ramp until a series of dogs engages the inside wall of an outer tubular member. At that point the swage will be at the necessary position on the ramp to adequately expand the inner tubular for a proper supporting relation to the outer tubular. If the inside diameter of the outer tubular is at the high end of the tolerance allowed by API specifications, the diameter of the swage is increased to compensate. Similarly, if the inside diameter of the outer tubular is at the low end of the tolerance range of API specifications, then the dogs make contact with the inside wall sooner and the resulting diameter of the swage is necessarily smaller.

DETAILED DESCRIPTION OF THE PREFERRED EMBODIMENT

Figure 1:
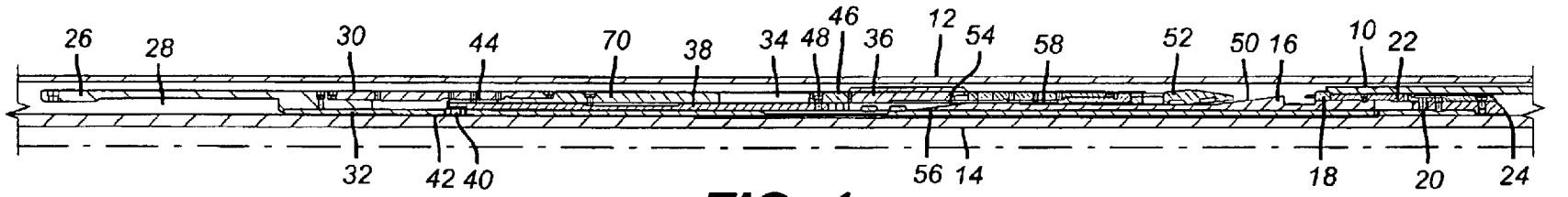
FIG. 1 is a sectional view of the apparatus in the run in position.
Figure 2:
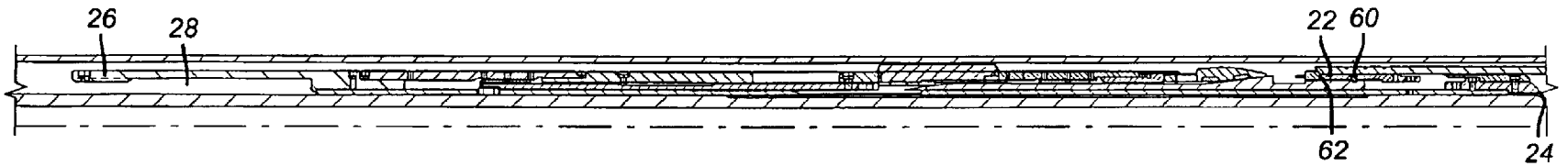
FIG. 2 is the view of FIG. 1 with the calibrating dogs making contact with the inside wall of the tubular.

Referring to FIG. 1, the liner or other tubular or screen, hereinafter tubular, 10 is suspended in casing 12 by a running tool known in the art. Typically the tubular 10 has a liner setting sleeve, not shown, into which a running tool is inserted for support for run in. A portion of such a running tool 14 is shown in FIG. 1. During run in a cone 16 is supported off the tubular 10 by a dog or dogs 18. Initially, the running tool 14 must break a shear pin 20 that is put there for the purpose of preventing a premature actuation during the trip downhole. Initially, shear pin 20 holds together sleeve 22, which is supported initially off of tubular 10 by dogs 18, and lower sub 24. FIG. 2 shows the shear pin 20 broken and the sleeve 22 supported off the tubular 10 with the lower sub 24 translated down due to a pushing force applied at the other end to top sub 26 by other portions of the running tool (not shown) that engage at recess 28.

Figure 3:
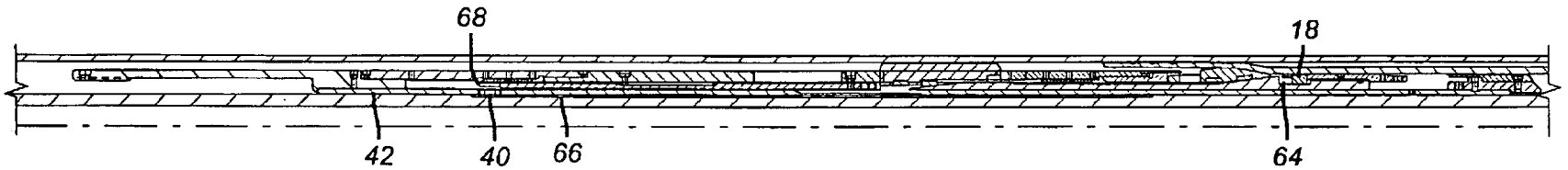
FIG. 3 is the view of FIG. 2 showing swaging having gone on to the point where the calibrating dogs have reached a position where they can retract to enter the tubing being expanded.

The dogs 18 resist downward movement of the cone 16 when the push force is applied to top sub 26. Also connected to top sub 26 is inner sleeve 32 that extends all the way down to lower sub 24. It is the tandem movement of sub 26 and inner sleeve 32 that results in the initial shearing of pin 20. Also connected to top sub 26 is outer sleeve 30 that is connected to outer body 70 that has an elongated slot 34 through which calibrating dogs 36 extend. A middle sleeve 38 is initially connected to outer sleeve 30 by virtue of supporting dogs 40 that rest on surface 42 during run in. Dogs 40 support middle sleeve 38 against ratchet assembly 44. As long as dogs 40 are supported by surface 42 dogs 40 forces the middle sleeve 38 to ride down in tandem with outer sleeve 30. Since calibrating dogs 36 are in a slot 34 in outer body 70, downward movement of outer body 70 will not push on the calibrating dogs 36. However, calibrating dogs 36 are enclosed by blocks 46 held by screws 48 to middle sleeve 38 that will push the calibrating dogs 36 downwardly. It should be recalled that cone 16 has a lower sloping surface 50 adjacent swage assembly 52. The swage assembly 52 can be a ring split into a number of segments or a collet with slots or any variation of a swage with the capability to change swaging diameter. Cone 16 also has an upper sloping surface 54 near mating sloping surface 56 on calibrating dogs 36. A lock ring assembly 58 allows the swage assembly 52 to move along lower sloping surface 50 in a downhole direction responsive to a pushing force from top sub 26. Cone 16 is prevented at this time from moving downhole because it is supported by dogs 18 on tubular 10, which is still retained by the running tool 14. This motion of the swage assembly 52 downhole along sloping surface 50 is unidirectional because lock ring assembly 58 prevents reverse motion. Swage assembly 52 is free to move along sloping surface 50 until calibrating dogs 36 engage the inner wall of the casing 12 as shown in FIG. 2. Blocks 46 push calibrating dogs 36 down until their sloping surface 56 rides up sloping surface 54 of cone 16. As the calibrating dogs 36 move outwardly and downwardly, the swaging assembly 52 does the same. When the calibrating dogs 36 make contact with the casing 12 the applied force on top sub 26 transfers down to dogs 18 through the cone 16. As shown in FIG. 2, shear pin 60 breaks because sleeve 22 is shouldered against the tubular 10 at shoulder 62. When shear pin 60 breaks, cone 16 can move downhole, putting recess 64 opposite dogs 18. The cone 16 can advance into the tubular 10 as the swage assembly 52 comes into contact with the tubular 10 and the swaging is initiated or continued. After a predetermined advancement of the swaging assembly 52, the dogs 40 become unsupported as surface 42 moves away and recess 66 presents itself opposite dogs 40. When this happens, dogs 40 can no longer shoulder middle sleeve 38. A ratchet assembly 44 allows the middle sleeve 38 to move upward direction relative to outer sleeve 30 responsive to pushing force from top end of the tubular 10 when calibrating dogs 36 make contact with tubular 10. This leaves the calibrating dogs 36 to move back down sloping surface 54 of the cone 16 as the cone 16 continues to advance and drive the swaging assembly 52 into the tubular 10. The motion of the calibrating dogs 36 moving back down sloping surface 54 of cone 16 is unidirectional because ratchet assembly 44 prevents reverse motion. Comparing FIGS. 3 and 4, it can be seen that the upper end 68 of middle sleeve 38 has shifted uphole with respect to dogs 40, which have become unsupported in recess 66. When the swaging is complete, the running tool can be turned to the right or otherwise released in a known manner to bring it out of the tubular 10 and to the surface leaving in the wellbore only the tubular 10 with a portion expanded into supporting contact with casing 12.

Figure 4:
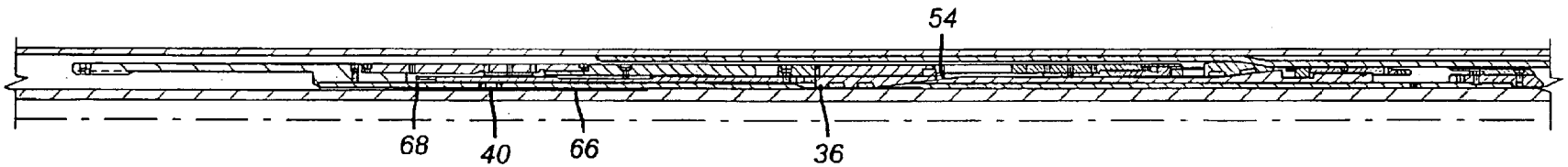
FIG. 4 is the view of FIG. 3 showing the completion of the expansion with the calibrating dogs inside the already expanded portions of the inner tubular.

The major components having now been described as well as their movements, the operation of the tool will now be reviewed in a more concise manner. The tubular 10 is supported from a running tool 14 in a known manner. The running tool 14 is capable of supporting the tubular 10 while putting a downward force on top sub 26 at the same time. Initially, the shear pin 20 breaks. Then, with the cone 16 supported off tubular 10 at dogs 18, the swaging assembly 52 is forced down sloping surface 50 while the calibrating dogs 36 ride outwardly on sloping surface 54. Eventually, the calibrating dogs 36 contact the casing 12. The swage assembly has irreversibly moved down sloping surface 50 and can't go in a reverse direction due to lock ring assembly 58. At this point the swage assembly has been moved to a proper diameter for expansion of the tubular 10, taking into account the actual internal diameter of the casing 12 in the region of the proposed expansion. Further downward force applied to top sub 26 forces shear pin 60 to break and allows recess 64 to become aligned with dogs 18. The cone 16 can now advance into the tubular 10 as the swage assembly 52, now at the proper diameter as determined by the inside diameter of the casing 12, continues to swage the tubular 10. After a predetermined travel of swage assembly 52, dogs 40 become undermined as recess 66 comes into position opposite dogs 40. The middle sleeve 38 becomes free from the shouldering of the dogs 40 such that blocks 46 no longer push on calibrating dogs 36. Instead, calibrating dogs 36 are now able to slide down sloping surface 54 of cone 16 as it advances downhole due to dogs 18 being disposed in recess 64.The calibrating dogs 36 can now advance into the already expanded portion of the tubular 10 as shown in FIG. 4. At the conclusion of the swaging operation, the running tool, of a type known in the art, can be given a turn to the right or otherwise released to leave the swaged tubular 10 securely supported from the casing 12 with the proper amount of force and with assurance that the casing has not been overstressed due to over-expansion.

Those skilled in the art will appreciate that the apparatus of the present invention takes into account the actual internal dimension of the casing 12 into which the tubular 10 is to be expanded. This internal diameter can vary considerably within the allowable tolerance by API. If the tubular is at the low end of the diameter range allowed by API, the calibrating dogs 36 will contact the casing 12 sooner rather than later. The sooner the calibrating dogs 36 contact the casing 12, the smaller the maximum diameter to which the swage assembly 52 will grow. Conversely, when the inside diameter of the casing 12 is at the high end of API tolerances and a greater degree of expansion of the tubular 10 is necessary for its proper support from the casing 12, the apparatus adjusts the size of the swage assembly 52 in direct relation to the sensed internal diameter of the casing 12 to allow the proper amount of expansion for necessary support of tubular 10 without expanding or over-expanding the surrounding casing 12. Casing 12 could potentially be elastically deformed, however, the compensating feature of the present invention that senses its internal diameter should prevent a situation of undue expansion of the surrounding casing 12.

The adaptability and simplicity of the present invention makes it economical to manufacture and reliable in operation in a wide range of variation for a given casing size. Those skilled in the art can envision modification of the described design to handle different casing sizes without part change-outs. Additionally information as to the detected inside diameter of the casing 12 can be obtained with the apparatus and transmitted to the surface. Additionally the final expanded inside diameter of the tubing 10 can be sensed and transmitted to the surface using known techniques.

The foregoing disclosure and description of the invention are illustrative and explanatory thereof, and various changes in the size, shape and materials, as well as in the details of the illustrated construction, may be made without departing from the spirit of the invention.

We claim:

1. An expansion apparatus for expanding an inner tubular against an outer tubular, said outer tubular having an inner surface, comprising:

a body;

a swage mounted for relative movement with respect to said body such that said relative movement changes the outer dimension of said swage; and a calibration assembly mounted to said body to sense the size of the inner surface of the outer tubular and limit said relative movement of said swage with respect to said body.

2. The apparatus of claim 1, wherein:

said swage grows in size as said calibration assembly approaches the inner surface of the outer tubular.

3. The apparatus of claim 1, wherein:

said calibration assembly locks the size of the swage to a size determined by the sensed inner surface of the outer tubular.

4. The apparatus of claim 1, wherein:

said swage and said calibration assembly move outwardly from said body in tandem until said calibration assembly contacts the inner surface of the outer tubular.

5. An expansion apparatus for expanding an inner tubular against an outer tubular, said outer tubular having an inner surface, comprising:

a body;

a swage mounted for relative movement with respect to said body such that said relative movement changes the outer dimension of said swage; and a calibration assembly mounted to said body to sense the size of the inner surface of the outer tubular and limit said relative movement of said swage with respect to said body;

said calibration assembly is selectively collapsible after sensing the inner surface of the outer tubular.

6. The apparatus of claim 5, wherein:

said calibration assembly is retained in a collapsed position after said collapsing.

7. The apparatus of claim 5, wherein:

said calibration assembly collapses to a dimension no larger than the maximum diameter obtained by said swage.

8. An expansion apparatus for expanding an inner tubular against an outer tubular, said outer tubular having an inner surface, comprising:

a body;

a swage mounted for relative movement with respect to said body such that said relative movement changes the outer dimension of said swage;and a calibration assembly mounted to said body to sense the size of the inner surface of the outer tubular and limit said relative movement of said swage with respect to said body;

said body further comprises a cone assembly and said calibration assembly comprises at least one dog, said cone causes said swange and said dog to move outwardly from said body until said dog contacts the inner surface of the outer tubular.

9. The apparatus of claim 8,further comprising:

a ratchet mechanism to prevent said swage from getting smaller once said cone has increased the size of said swage to a dimension determined by engagement of said dog to the inner surface of the outer tubular.

10. The apparatus of claim 8,further comprising:

a first inclined surface on said cone to bias said swage away from said body and a second inclined surface on said cone to bias said dog toward the inner surface of the outer tubular.

11. The apparatus of claim 8, further comprising:

a selective support for said cone on the inner tubular, said selective support remaining in effect until said dog contacts the inner surface of the outer tubular, whereupon said cone advances in tandem with said swage into the inner tubular.

12. The apparatus of claim 11, further comprising:

said dog, after said collapse, advances into the inner tubular that has previously been expanded by said swage.

13. The apparatus of claim 8, further comprising:

a ratchet on said body, said ratchet initially locked to allow relative movement between said cone and said dog to drive said dog toward the inner surface of the outer tubular, said ratchet subsequently released to allow said dog to collapse along said cone and away from the inner surface of the outer tubular.

14. The apparatus of claim 13, wherein:

said ratchet is held in said locked position by a support dog that becomes undermined by relative movement between said cone and said body.

15. An expansion apparatus for expanding an inner tubular against an outer tubular, said outer tubular having an inner surface, comprising:

a body;

a swage mounted for relative movement with respect to said body such that said relative movement changes the outer dimension of said swage;and a calibration assembly mounted to said body to sense the size of the inner surface of the outer tubular and limit said relative movement of said swage with respect to said body;

said swage, whose maximum size is determined by said calibrating assembly sensing the size of the inner surface of the outer tubular, expands the inner tubular into the outer tubular to a point short of overstressing the outer tubular.

16. An expansion apparatus for expanding an inner tubular against an outer tubular, said outer tubular having an inner surface, comprising:

a body:

a swage mounted for relative movement with respect to said body such that said relative movement changes the outer dimension of said swage;and a calibration assembly mounted to said body to sense the size of the inner surface of the outer tubular and limit said relative movement of said swage with respect to said body;

said calibrating assembly senses the size of the inner surface of the outer tubular at a point close enough to the end of the inner tubular such that advancement of said swage allows said calibrating assembly to enter the inner tubular.

17. The apparatus of claim 16, wherein:

said calibration assembly collapses due to advancement of said swage so that it can enter the inner tubular.

* * * * *